US009855453B2

(12) United States Patent
Day

(10) Patent No.: US 9,855,453 B2
(45) Date of Patent: Jan. 2, 2018

(54) EXERCISE DEVICE AND METHOD

(71) Applicant: Jason William Day, Vancouver (CA)

(72) Inventor: Jason William Day, Vancouver (CA)

( * ) Notice: Subject to any disclaimer, the term of this patent is extended or adjusted under 35 U.S.C. 154(b) by 0 days.

(21) Appl. No.: 15/094,826

(22) Filed: Apr. 8, 2016

(65) Prior Publication Data

US 2016/0296802 A1 Oct. 13, 2016

Related U.S. Application Data

(63) Continuation-in-part of application No. 14/682,291, filed on Apr. 9, 2015.

(51) Int. Cl.
*A63B 5/22* (2006.01)

(52) U.S. Cl.
CPC ..... *A63B 5/22* (2013.01); *A63B 2209/02* (2013.01); *A63B 2209/14* (2013.01); *A63B 2210/54* (2013.01)

(58) Field of Classification Search
CPC ... A63B 23/0464; A63B 69/0028; A63B 5/11; A63B 19/00
USPC ..... 472/85–87, 93
See application file for complete search history.

(56) References Cited

U.S. PATENT DOCUMENTS

| | | | | |
|---|---|---|---|---|
| 3,006,645 | A | 10/1961 | Frazier | |
| 3,051,482 | A | 8/1962 | Harpham | |
| 3,425,690 | A * | 2/1969 | Charbonnet | A63B 19/00 482/110 |
| 3,532,340 | A | 10/1970 | Nardiello | |
| 4,537,393 | A | 8/1985 | Kush | |
| 5,538,454 | A * | 7/1996 | Kessler | A63B 19/00 273/336 |
| 5,984,836 | A | 11/1999 | Casali | |
| 6,019,608 | A | 2/2000 | Stark | |
| 6,155,495 | A * | 12/2000 | Jones | A63B 5/11 239/289 |
| 2008/0227608 | A1* | 9/2008 | Sapia | A63B 19/00 482/110 |
| 2011/0021322 | A1* | 1/2011 | Schaffer | A63B 5/11 482/29 |
| 2014/0081185 | A1* | 3/2014 | Azevedo | A63B 69/0059 601/23 |

OTHER PUBLICATIONS

Non-Final Office Action dated Aug. 19, 2016 for U.S. Appl. No. 14/682,291.

* cited by examiner

*Primary Examiner* — Loan H Thanh
*Assistant Examiner* — Jennifer M Deichl
(74) *Attorney, Agent, or Firm* — Snell & Wilmer LLP

(57) ABSTRACT

The present invention provides an exercise device comprising: an outer ring; an inner ring located within the outer ring; and a plurality of spokes connecting the inner ring and the outer ring. A method of use is also provided.

15 Claims, 10 Drawing Sheets

10
24a
24b
24c
24d
24e
24f
24g
24h
24i
17
12
14
16

10
24j
24k
24l
24m
24n
24p
24q
24r
24s
24t
17
A
A
B
B
12
14
16

SECTION A-A OF FIG.3

SECTION B-B OF FIG.3

EXERCISE DEVICE AND METHOD

CROSS-REFERENCE TO RELATED APPLICATIONS

This Application claims priority to and is a Continuation-in-Part of U.S. patent application Ser. No. 14/682,291, entitled "AGILITY TRAINER," filed on Apr. 9, 2015, which is hereby incorporated by reference.

FIELD

The present invention relates to exercising. More particularly, the present invention relates to a circular exercise device and method of use thereof.

BACKGROUND

One method of agility training involves stepping into and out of tires arranged in various patterns. Setting up patterns of tires or other such objects is time consuming and laborious.

An agility ladder resembles a typical ladder placed on a horizontal surface, but it has side rails and rungs made of fabric and/or plastic. In use, known agility ladders are equivalent to a linear arrangement of tires, but they do not provide a convenient means for varying direction during agility training. Furthermore, the flexible materials used in agility ladders means that they must be manually spread out on the horizontal surface for setup and that they will not hold their useful shape when unintentionally contacted by the moving foot of a user stepping over the rungs/rails.

The present invention addresses at least one of the above-identified shortcomings.

SUMMARY

Various embodiments of the present invention relate to an exercise device comprising: an outer ring; an inner ring located within the outer ring; and a plurality of spokes connecting the inner ring and the outer ring; wherein at least one of the inner ring and the plurality of spokes are elastic and configured to urge the plurality of spokes into a radial configuration.

The device may be configured such that a user can step from any position within the region defined by the inner surface of the inner ring to any region of a plurality of regions defined by the outer ring, the plurality of spokes and the inner ring.

The inner ring may be elastic and the plurality of spokes may be flexible. The inner ring may be comprised of a bungee-type material. Alternatively, the plurality of spokes may be elastic and the inner ring may be flexible.

The outer ring may comprise an internal ring support encased in a fabric sheath. The plurality of spokes may be connected to the fabric sheath.

Each spoke of the plurality of spokes may have a non-adjustable length.

The plurality of spokes may consist of 4 to 16 spokes. The plurality of spokes may consist of 12 spokes.

The outer ring may have a circular shape that is resiliently deformable.

The outer ring may comprise a ring formed of a fiber-reinforced plastic polymer.

The outer ring may be twistable into two or more circular portions which fold to form a smaller ring.

Various embodiments of the present invention relate to a method of exercising, the method comprising: placing the exercise device of claim 1 on a substantially flat horizontal surface; and directing a user to follow a sequence of steps between a plurality of regions, the plurality of regions selected from: the inner region defined by the inner surface of the inner ring; the plurality of regions defined by the outer ring, the plurality of spokes and the inner ring; and the outer region defined by the outer surface of the outer ring.

The method may further comprise timing the user performing the sequence of steps.

This summary of the invention does not necessarily describe all features of the invention.

BRIEF DESCRIPTION OF THE DRAWINGS

These and other features of the invention will become more apparent from the following description in which reference is made to the appended drawings.

DETAILED DESCRIPTION

Figure 1:
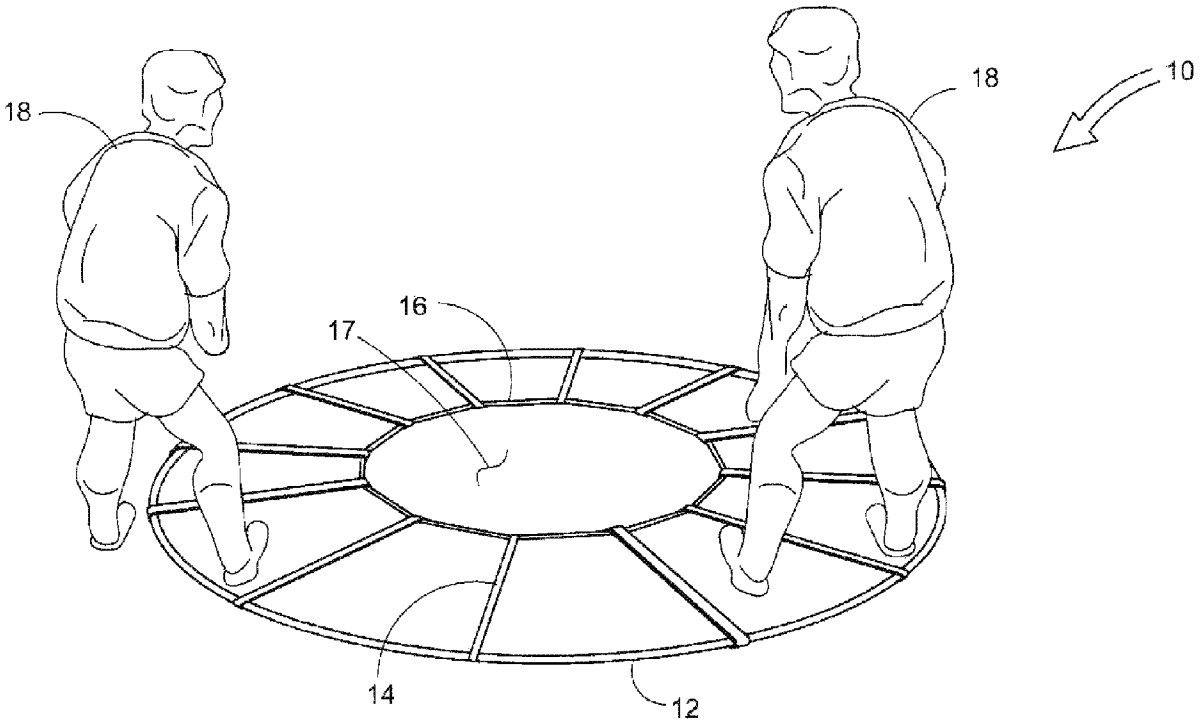
FIG. 1 shows a perspective view of an exercise device in accordance with one embodiment of the present invention, in which the device is displayed in an environment of use. The device has adjustable spokes arranged to be of congruent lengths.
Figure 2:
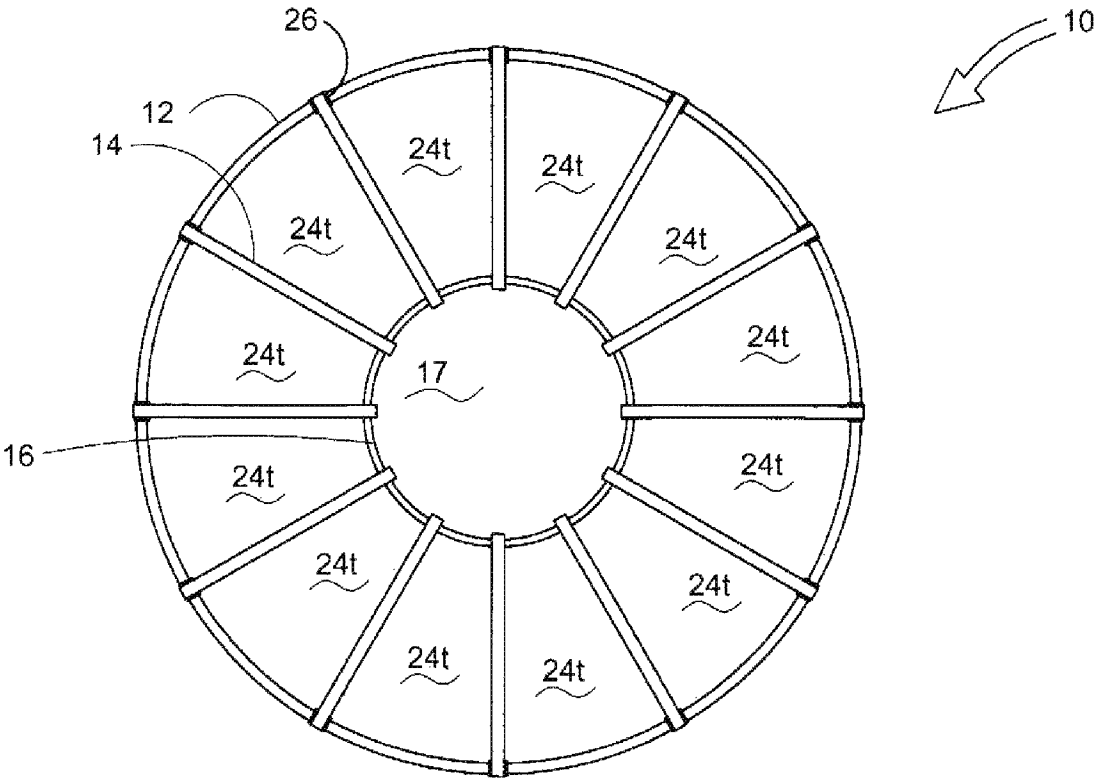
FIG. 2 shows a plan view of the device of FIG. 1.

The following description is of a preferred embodiment.

As used herein, the terms "comprising," "having", "including" and "containing," and grammatical variations thereof, are inclusive or open-ended and do not exclude additional, unrecited elements and/or method steps. The term "consisting of" when used herein in connection with a composition, use or method, excludes the presence of additional elements and/or method steps.

A reference to an element by the indefinite article "a" does not exclude the possibility that more than one of the elements is present, unless the context clearly requires that there be one and only one of the elements. The singular forms "a", "an", and "the" include plural referents unless the content clearly dictates otherwise. The use of the word "a" or "an" when used herein in conjunction with the term "comprising" may mean "one," but it is also consistent with the meaning of "one or more," "at least one" and "one or more than one."

Unless indicated to be further limited, the term "plurality" as used herein means more than one, for example, two or more, three or more, four or more, and the like.

In this disclosure, the recitation of numerical ranges by endpoints includes all numbers subsumed within that range including all whole numbers, all integers and all fractional intermediates (e.g., 1 to 5 includes 1, 1.5, 2, 2.75, 3, 3.80, 4, and 5 etc.).

The present disclosure relates to an exercise device comprising: an outer ring; an inner ring located within the outer ring; and a plurality of spokes connecting the inner ring and the outer ring. The outer ring, the inner ring and the spokes thus define a number of discrete regions or zones, including a circular inner region surrounded by at least one ring of regions, said at least one ring or regions further surrounded by a region defined by the outer surface the outer ring. By adding additional crossing members between the spokes, additional rings of regions are added, such that the device begins to resemble a web.

The device is useful for exercise. For example, but without limitation, the device may be used for agility training or any other exercise method in which a user performs a sequence of steps into and out of the regions defined by the device. The user may alternatively or additionally place other body parts (e.g. hands, knees and/or elbows) in the regions defined by the device.

The user may be a human or any other animal. The user may be a child or an adult. More than one user may use the device simultaneously.

The device may be any size and dimensions, depending on the exercise method of interest. For example, in some embodiments, the device may be configured such that a user can step from any position within the inner region defined by the inner surface of the inner ring to any region of a plurality of intermediate regions defined by the outer ring, the plurality of spokes and the inner ring. In other embodiments, the device may be configured such that a user cannot step from any position within the inner region to at least one intermediate region. In some embodiments, the device may be further configured such that the user is capable of stepping or jumping from within the inner region to the outer region. In other embodiments, the device may be configured such that the user is not capable of jumping directly from within the inner region to the outer region. For example, but without limitation, the outer ring may have a diameter of at least 4, 5, 6, 7, 8, 9, 10, 12, 13, 14, 15, 16, 17, 18, 19 or 20 feet, or any decimal value in-between. In some embodiments, the outer ring may have a diameter of about 6 feet. Without limitation, the inner ring may have a diameter of at least 2, 2.5, 3, 3.5, 4, 5, 6, 7, 8, 9, 10, 11, 12, 13, 14, 15, 16, 17, 18, 19, or any decimal value in-between. In some embodiments, the inner ring may have a diameter of about 34 inches.

As used herein, the term "spoke" has the same meaning as "connecting member" and is no more limiting. A spoke thus includes a connecting member of any suitable dimensions or material. A spoke need only be wide enough to be visible to the user (e.g. less than 1/32, 1/32, 1/16, 1/8, 1/4, 3/4, 1, 1 1/4, 1 1/2, 1 3/4, 2, more than 2 inches, or any fraction in-between). The "plurality of spokes" may consist of 2, 3, 4, 5, 6, 7, 8, 9, 10, 11, 12, 13, 14, 15, 16, 17, 18, 19, 20, or more than 20 spokes. In some embodiments, the plurality of spokes may consist of 4 to 16 spokes. In some embodiments, the plurality of spokes may consist of 12 spokes.

The outer ring may be made of (e.g. formed or otherwise manufactured from) or comprise a rigid or quasi-rigid material capable of maintaining its circular shape. For example, but without limitation, the outer ring may be made or comprised of metal, wood, plastic, a polymer, rubber, a combination thereof or any other suitable material. The polymer may be fiber-reinforced, e.g. fiberglass or carbon-fiber reinforced.

In some embodiments, the outer ring may be hollow, but in other embodiments, the outer ring may be solid.

In some embodiments, the outer ring may have a circular-shaped cross-section, but in other embodiments, the outer ring may have a square, rectangular, triangular or any other shape of cross-section.

In some embodiments, the circular shape of the outer ring may be resiliently deformable. For example, the outer ring may comprise a ring formed of a fiber-reinforced plastic polymer, for example, a fiberglass composite.

In some embodiments, the outer ring may comprise an internal ring support encased in a sheath (e.g. a fabric, plastic, or polymer sheath). Alternatively, the outer ring may not comprise a sheath or may only consist of a ring support.

In embodiments in which the outer ring comprises a sheath, the plurality of spokes may be connected to the sheath by any suitable means, including without limitation stitching, rivet(s), glue, bolt(s), integral formation, loop and hook (e.g. Velcro™), and the like.

The inner ring may be rigid or flexible. The spokes may be rigid or flexible. In some embodiments, at least one of the inner ring and the plurality of spokes are elastic. In some embodiments at least one of the inner ring and the plurality of spokes are elastic and configured to urge the plurality of spokes into a radial configuration. By "radial configuration", it is meant that the spokes lie along axes which converge at the center of the inner ring. In some embodiments, the inner ring is elastic and the plurality of spokes are flexible. In some embodiments, the inner ring is flexible and the plurality of spokes are elastic. Any suitable elastic material may be used for the spokes and/or inner ring, as the case may be, including without limitation: rubber, coil spring (e.g. metal), bungee-type material, and the like.

In some embodiments, the plurality of spokes may be non-adjustable. In some embodiments, the plurality of spokes may be adjustable. For example, a spoke may connect to the outer ring and/or inner ring by looping around said ring(s) and fastening back on itself (e.g. by using loop and hook surfaces, or any other means of removable attachment).

The lengths of the spokes may be the same (i.e. congruent) or different (i.e. non-congruent).

In embodiments where the circular shape of the outer ring is resiliently deformable, the outer ring may be twistable into two or more circular portions (e.g. 2, 3, 4 or more than four circular portions) which fold up to form a smaller ring. The smaller ring is thus more compact for storage (e.g. in a storage sac or other container), or can be kept compact by means of a removable fastener which prevents the folded device from springing open. In some embodiments, the outer ring is twistable into two circular portions. In some embodiments, the outer ring is twistable into three circular portions.

Also provided is a method, of exercising, comprising a user following a sequence of steps between a plurality of regions, the plurality of regions selected from: the inner region defined by the inner surface of the inner ring; the plurality of intermediate regions defined by the outer ring, the plurality of spokes and the inner ring; and the outer region defined by the outer surface of the outer ring. Prior to this step, the method optionally comprises placing the exercise device on a substantially flat horizontal surface. The method may alternatively comprise directing the user to perform the sequence of steps.

In some embodiments, the method may further comprise timing the user performing the sequence of steps. In other embodiments, the user is not timed.

EXAMPLE 1

An exemplary embodiment is shown in FIGS. 1 to 11.

Referring first to FIG. 1, device 10 includes an inner ring 16 and outer ring 12 and a plurality of spokes 14 connected from inner ring 16 to outer ring 12. In one embodiment, as demonstrated in FIG. 2, spokes 14 are congruent and form substantially equal step region 24*t* positioned between inner ring 16 and outer ring 12. Inner ring 16 defines inner region 17.

Figures 3, 4:
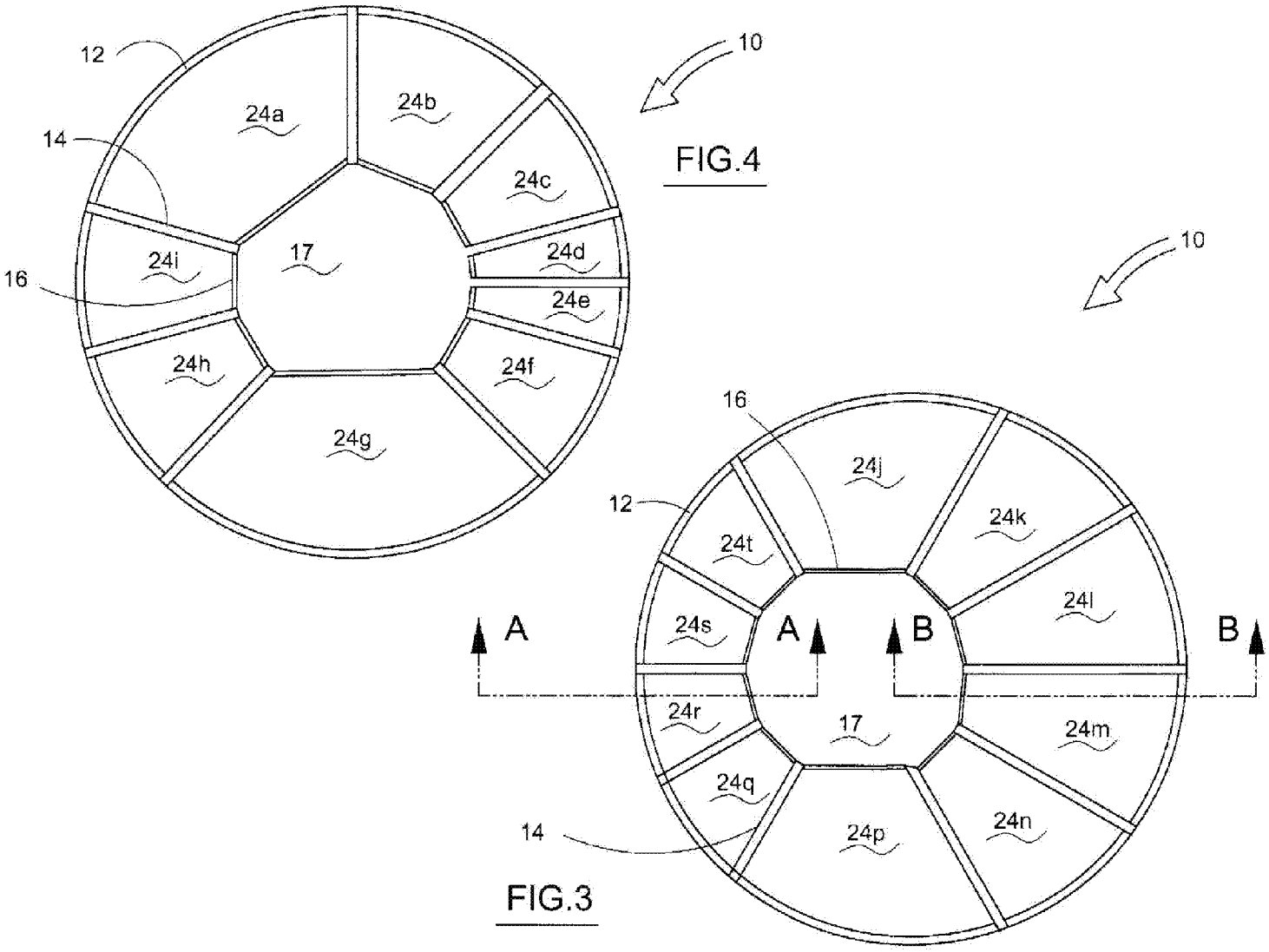
FIG. 3 shows a plan view of the device of FIG. 1, arranged in a first configuration with non-congruent spokes, such that inner ring is not concentric with the outer ring.
FIG. 4 shows a plan view of the device of FIG. 1, arranged in a second configuration with non-congruent spokes, such that inner ring is not concentric with the outer ring.
Figure 6:
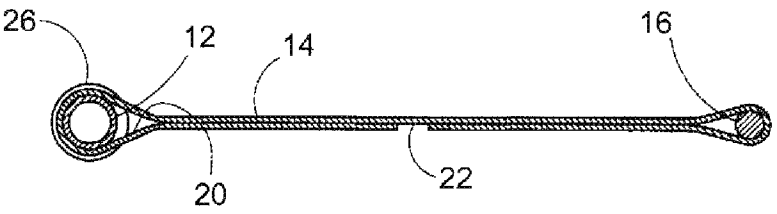
FIG. 6 shows a side cross-sectional view of a portion of the device of FIG. 1, sectioned along line A-A of FIG. 3.

In another embodiment, as demonstrated in FIG. 3, each spoke 14 is incongruent one to another forming step regions 24*j*, 24*k*, 24*l*, 24*m*, 24*n*, 24*o*, 24*p*, 24*q*, 24*r*, 24*s*, and 24*t* that are incongruent.

In one embodiment, as shown in FIG. 4, spokes 14 are congruent one to another. Inner ring 16 is configured and positioned to provide an offset inner region 17 and each step region 24*a*, 24*b*, 24*c*, 24*d*, 24*e*, 24*f*, 24*g*, 24*h*, and 24*i* are incongruent.

Although each of FIGS. 3 and 4 demonstrate intermediate regions that are incongruent, one or more of the intermediate regions may be formed having congruent area.

Figure 5:
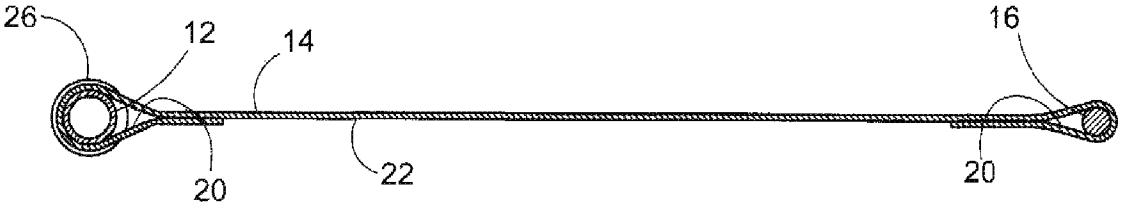
FIG. 5 shows a side cross-sectional view of a portion of the device of FIG. 1, sectioned along line B-B of FIG. 3.
Figure 7:
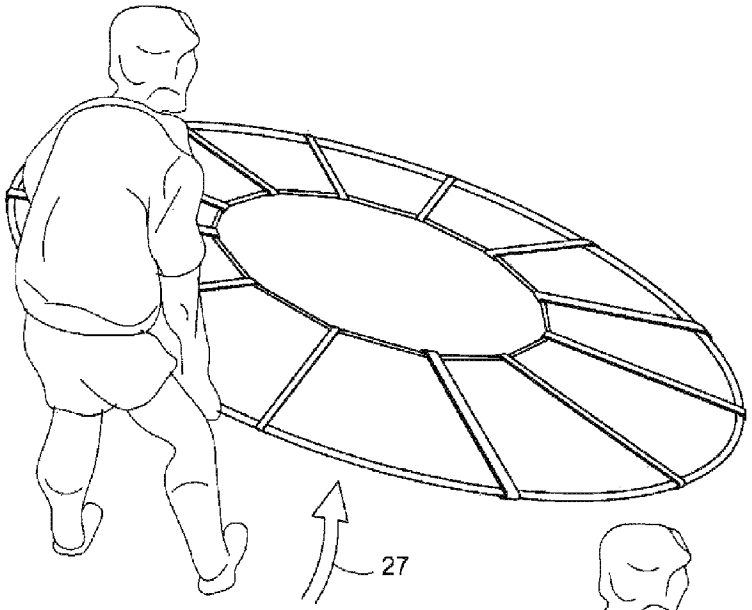
FIG. 7 shows a first step in storing the device of FIG. 1.
Figure 8:
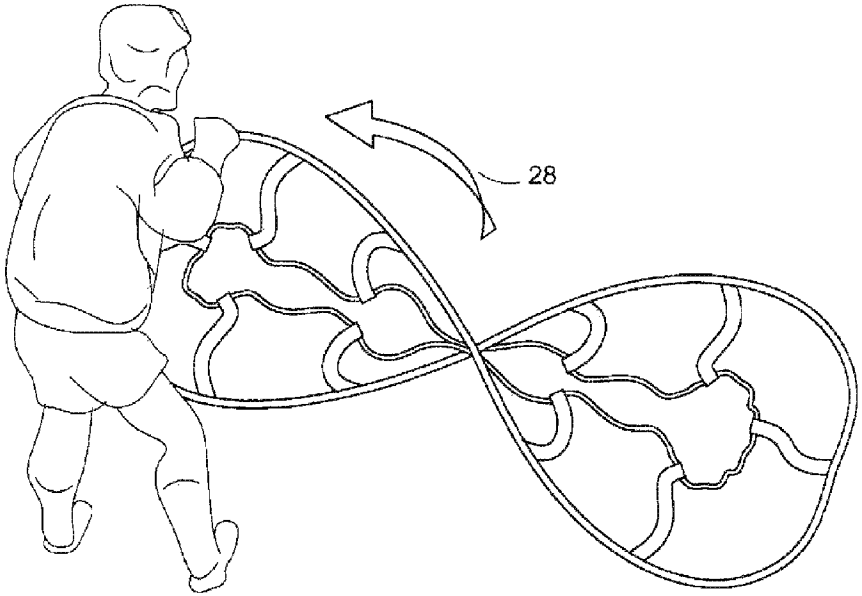
FIG. 8 shows a sequential step following the step shown in FIG. 7, displaying a twisting motion.
Figure 9:
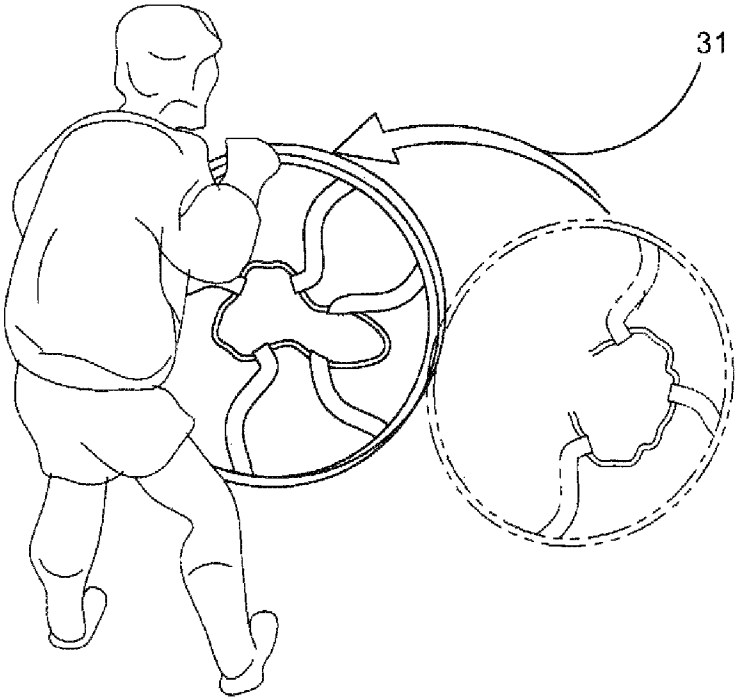
FIG. 9 shows a further sequential step following the step shown in FIG. 8, displaying folding the twisted device.
Figure 10:
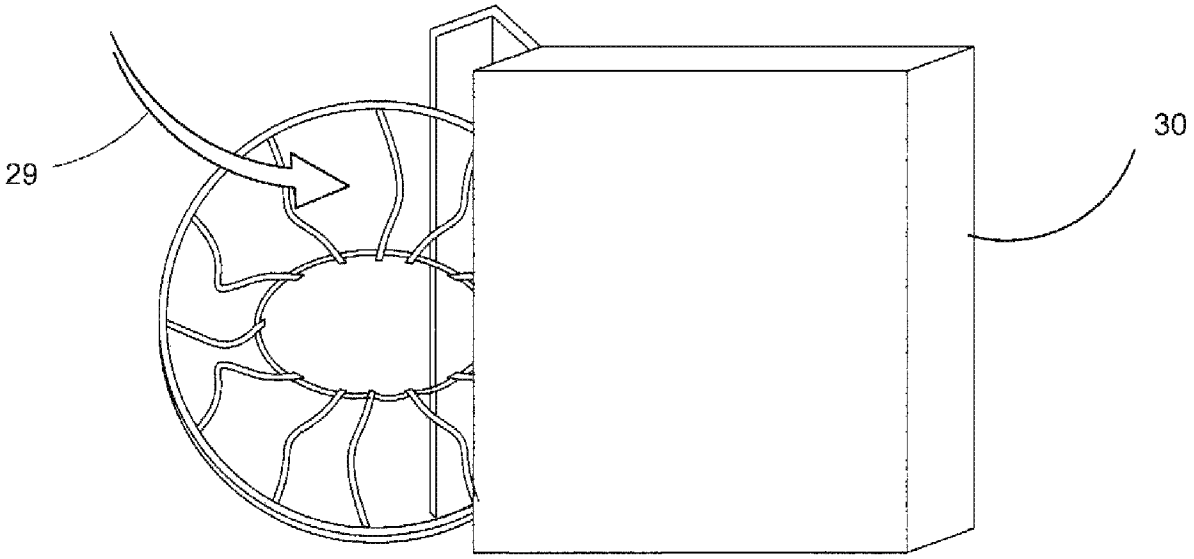
FIG. 10 shows a further sequential step following the step shown in FIG. 9, displaying storing the folded device.

As demonstrated in FIG. 5, each spoke 14 is connected to outer ring 12 and to inner ring 16 utilizing a hook surface 20 that releasably connects to a loop surface 14 in a cloak and loop fastener arrangement. As demonstrated in FIG. 6, by varying the length of each hook portion 20 relative to the outer ring 12 and/or the inner 16, a user can vary the length of spoke 14. In general, outer ring 12 is rigid (or semi-rigid) and remains in a fixed position where inner ring 16 is flexible and can be deformed as desired and demonstrated in each of the FIGS. 3 and 4.

FIGS. 7 through 10 demonstrate an arrangement whereby the device is folded and subsequently stored. Device 10 will be lifted in direction 27 off the floor, subsequently twisted in a manner shown by directional arrow 28 forming a pair of congruent circles that are folded one on top of another as demonstrated by directional arrow 31. The folded configuration is then placed as demonstrated by directional arrow 29 into a container 30.

Figure 11:
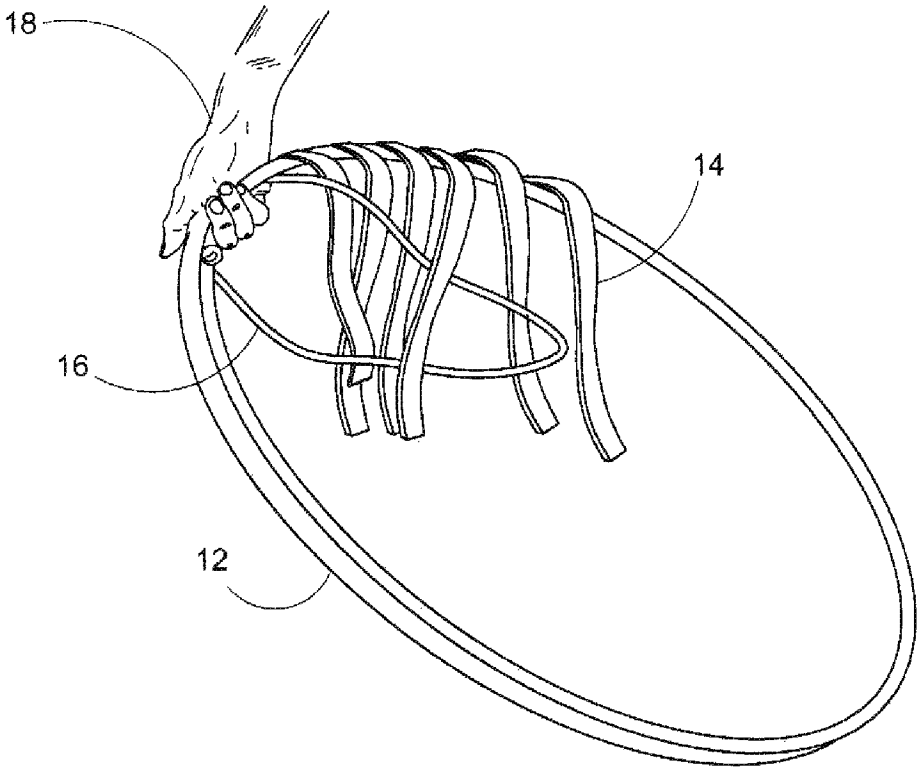
FIG. 11 shows a perspective view of the device of FIG. 1 in which the spokes are disassembled from the inner ring.

FIG. 11 shows that the adjustable spokes 14 can be disassembled from the inner ring 16.

In utilizing the embodiments described this Example, a user 18 is provided with device 10 and directed to step in particular step regions 24 according to the desired exercise routine.

EXAMPLE 2

Figure 12:
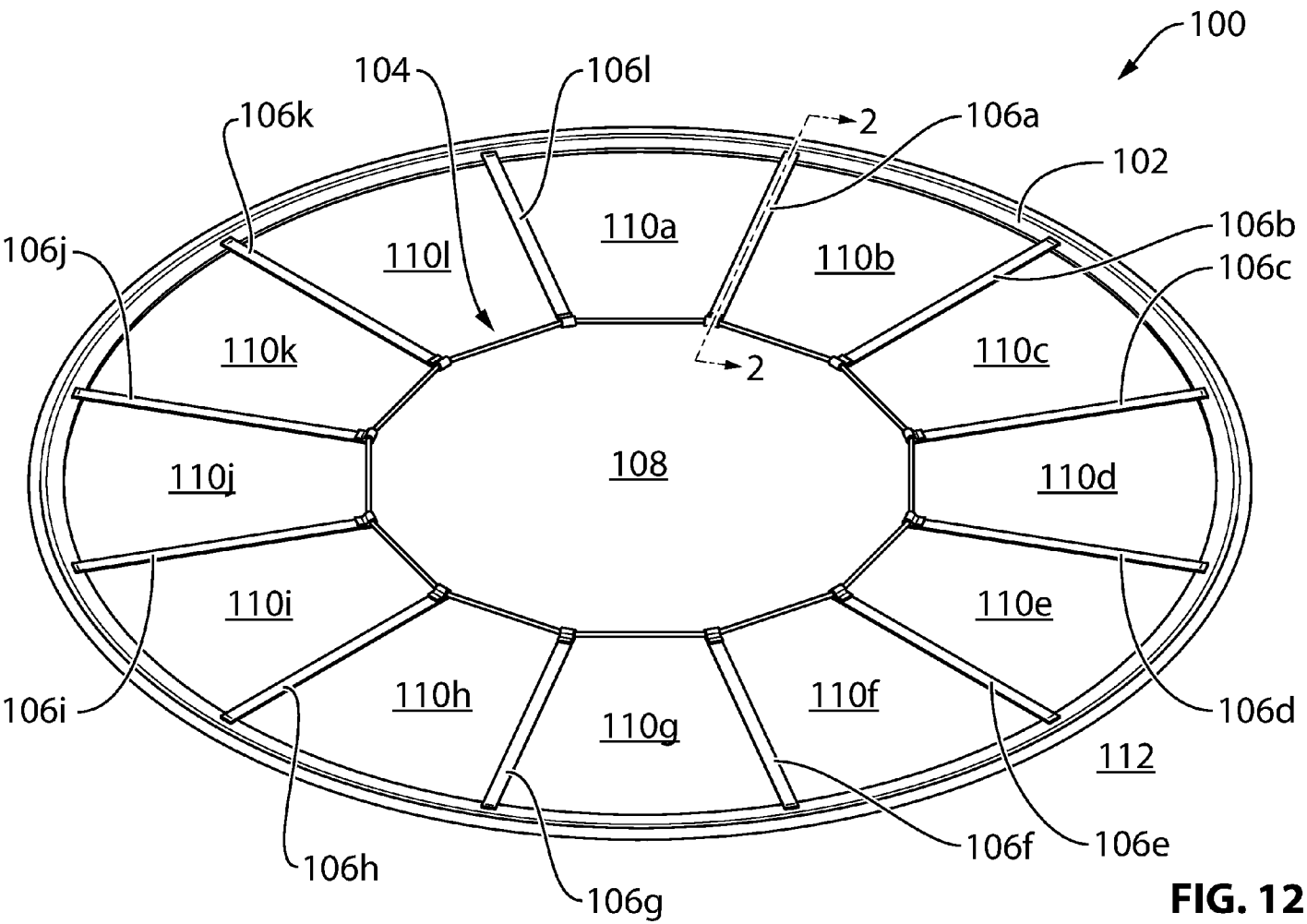
FIG. 12 shows a perspective view of an exercise device in accordance with another embodiment of the invention, the device has non-adjustable spokes arranged to be of congruent lengths. The outer ring of the device includes a sheath around an internal ring support.
Figure 13:
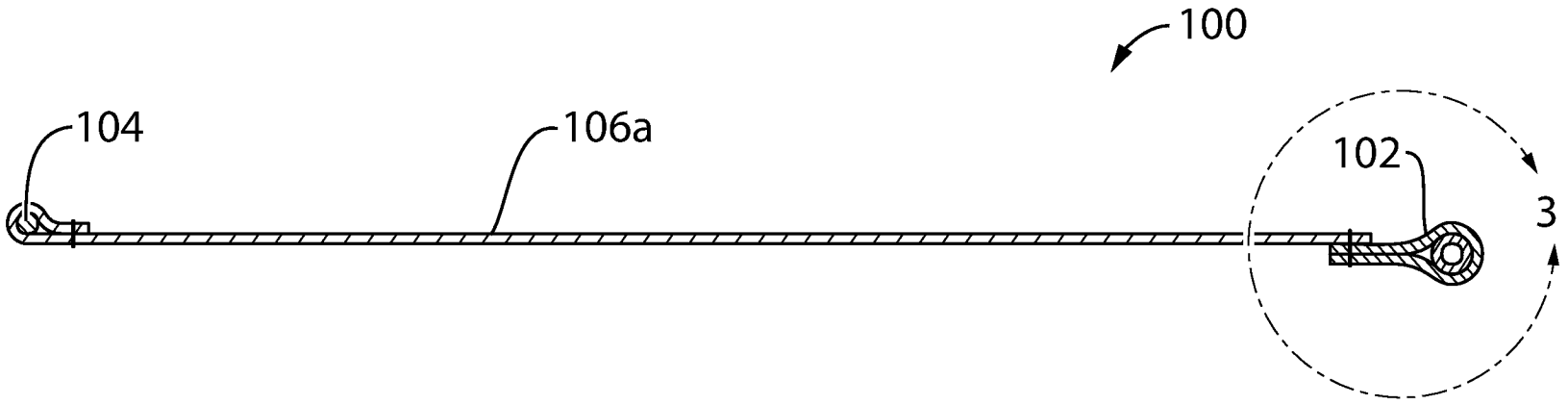
FIG. 13 shows a side cross-sectional view of a portion of the device of FIG. 12, sectioned along line 2-2 of FIG. 12.
Figure 14:
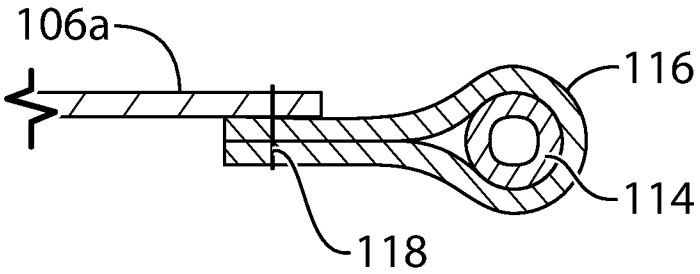
FIG. 14 shows a magnified detail view of area 3 in FIG. 13.

Referring now to an exemplary embodiment shown in FIGS. 12 to 14, exercise device 100 comprises an outer ring 102; an inner ring 104 located within the outer ring 102; and twelve spokes 106*a* to 106*l* connecting the inner ring 104 and the outer ring 102.

The outer ring 102 has a diameter of about 6 feet, the inner ring 104 has a diameter of about 34 inches and the spokes 106*a* to 106*l* each have a length of about 19 inches. At these dimensions, an average adult human user can step from any position within the inner region 108 defined by the inner surface of the inner ring 104 to any step region of the twelve regions 110*a* to 110*l* defined by the outer ring 102, the spokes 106*a* to 106*l* and the inner ring 104. Furthermore, at these dimensions, the average adult human user would be capable of stepping or at least jumping from within the inner region 108 to an outer region 112 defined by the outer surface of the outer ring 102.

The inner ring 104 is made of an elastic bungee-type material. The spokes 106*a* to 106*l* are made of woven fabric.

As shown in FIGS. 12, 13 and 14 (best shown in FIG. and 14), the outer ring 102 comprises an internal ring support 114 encased in a fabric sheath 116. The fabric sheath 116 is sewn (shown as stitching 118) to the spokes 106*a* to 106*l* to connect the outer ring 102 to the spokes 106*a* to 106*l*.

As shown in the cross-sectional view of device 100 in FIG. 13 (sectioned along line 2-2), the internal ring support 114 is a hollow fiberglass composite and has a circular-shaped cross-section having diameter of approximately 4 millimeters. The internal ring support 114 is made from a pole glued end to end in metal sleeve.

The spokes 106*a* to 106*l* have non-adjustable lengths. Since the spokes are attached to the outer ring 102 and the inner ring 104, the spokes 106*a* to 106*l* prevent the inner ring 104 from contracting to its resting circumference, which urges the spokes 106*a* to 106*l* into a radial configuration. Since the spokes 106*a* to 106*l* have congruent lengths, the inner ring 104 and the outer ring 102 are concentric.

Similar to device 10 described in Example 1, device 100 is twistable into two or three circular portions which fold to form a smaller ring that is one half or one third the diameter of the non-folded outer ring. The folded device 100 can be fastened in its folded state (e.g. using one or more Velcro™ loops) or stored in a bag or other container. Device 100 is thus simple to collapse for storage and simple to setup for use from storage as it will automatically expand as soon as it is released from its storage container or fastener.

In its unfolded state, device 100 can be used in a method of exercising. For example, the method may comprise: directing a user to follow a sequence of steps between a plurality of regions, the plurality of regions selected from: the inner region 108 defined by the inner surface of the inner ring 104; the plurality of regions 110*a* to 110*l* defined by the outer ring 102, the plurality of spokes 106*a* to 106*l* and the inner ring 104; and the outer region 112 defined by the outer surface of the outer ring 102. If device 100 is kicked or otherwise contacted during use, it will maintain its useful shape.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

What is claimed is:

1. An exercise device comprising:

an outer ring having a diameter of at least 4 ft;

an inner ring located within the outer ring, the inner ring having a diameter of at least 2 ft; and more than 6 spokes connecting the inner ring and the outer ring;

wherein at least one of the inner ring and the more than 6 spokes are elastic and configured to urge the more than 6 spokes into a radial configuration, wherein the device is configured such that a human user can step from any position within a region defined by an inner surface of the inner ring to any region of a plurality of regions defined by the outer ring, the more than 6 spokes and the inner ring, and wherein the outer ring is resiliently deformable.

2. The device of claim 1, wherein the inner ring is elastic and the more than 6 spokes are flexible.

3. The device of claim 1, wherein the more than 6 spokes are elastic and the inner ring is flexible.

4. The device of claim 1, wherein the outer ring comprises an internal ring support encased in a sheath.

5. The device of claim 4, wherein the more than 6 spokes are connected to the sheath.

6. The device of claim 1, wherein each spoke of the more than 6 spokes has a non-adjustable length.

7. The device of claim 1, wherein the more than 6 spokes consists of at most 16 spokes.

8. The device of claim 1, wherein the more than 6 spokes consists of 12 spokes.

9. The device of claim 1, wherein the outer ring has a circular shape.

10. The device of claim 1, wherein the outer ring comprises a ring formed of a fiber-reinforced plastic polymer.

11. The device of claim 1, wherein said outer ring is twistable into two or more circular portions which fold to form a smaller ring.

12. An exercise device comprising:

an outer ring having a diameter of at least 4 ft;

an inner ring located within the outer ring, the inner ring having a diameter of at least 2 ft; and more than 6 spokes connecting the inner ring and the outer ring;

wherein at least one of the inner ring and the more than 6 spokes are elastic and configured to urge the more than 6 spokes into a radial configuration, wherein the device is configured such that a human user can step from any position within a region defined by an inner surface of the inner ring to any region of a plurality of regions defined by the outer ring, the more than 6 spokes and the inner ring, and wherein the inner ring is comprised of a bungee-type material.

13. A method of exercising, the method comprising:

placing an exercise device on a substantially flat horizontal surface, wherein the exercise device comprises:

an outer ring;

an inner ring located within the outer ring; and a plurality of spokes connecting the inner ring and the outer ring;

wherein at least one of the inner ring and the plurality of spokes are elastic and configured to urge the plurality of spokes into a radial configuration; and directing a user to follow a sequence of steps between a plurality of regions, the plurality of regions selected from:

an inner region defined by an inner surface of the inner ring;

a plurality of intermediate regions defined by the outer ring, the plurality of spokes and the inner ring; and an outer region defined by an outer surface of the outer ring.

14. The method of claim 13, further comprising timing the user performing the sequence of steps.

15. An exercise device comprising:

an outer ring having a diameter of 5 to 7 ft;

an inner ring located within the outer ring, the inner ring having a diameter of 2 to 3 ft; and 10 to 14 spokes connecting the inner ring and the outer ring;

wherein at least one of the inner ring and the 9 to 15 spokes are elastic and configured to urge the 9 to 15 spokes into a radial configuration, wherein the device is configured such that a human user can step from any position within an inner region defined by an inner surface of the inner ring to any region of a plurality of regions defined by the outer ring, the 9 to 15 spokes and the inner ring, wherein the inner ring is comprised of a bungee-type material, and wherein said outer ring is twistable into two or more circular portions which fold to form a smaller ring.

* * * * *